US009250556B2

(12) United States Patent
Natsume et al.

(10) Patent No.: US 9,250,556 B2
(45) Date of Patent: Feb. 2, 2016

(54) IMAGE FORMING APPARATUS WITH ION GENERATION MODE

(71) Applicant: KONICA MINOLTA, INC., Chiyoda-ku (JP)

(72) Inventors: Munehiro Natsume, Toyokawa (JP); Teruhiko Toyoizumi, Tachikawa (JP); Nobuhiro Matsuo, Toyokawa (JP); Kouei Cho, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 79 days.

(21) Appl. No.: 13/887,795

(22) Filed: May 6, 2013

(65) Prior Publication Data

US 2013/0294789 A1 Nov. 7, 2013

(30) Foreign Application Priority Data

May 7, 2012 (JP) ..... 2012-106008

(51) Int. Cl.
*G03G 15/02* (2006.01)
*G03G 21/20* (2006.01)
*G03G 15/01* (2006.01)

(52) U.S. Cl.
CPC ..... *G03G 15/0258* (2013.01); *G03G 15/0189* (2013.01); *G03G 15/0266* (2013.01); *G03G 15/0291* (2013.01); *G03G 21/206* (2013.01);*G03G 2215/0132* (2013.01); *G03G 2215/0164* (2013.01)

(58) Field of Classification Search
CPC ..... G03G 21/206; G03G 15/0225; G03G 15/0258; G03G 15/0283; G03G 15/0291
USPC ..... 399/50, 89, 92
See application file for complete search history.

(56) References Cited

U.S. PATENT DOCUMENTS 5,032,870 A * 7/1991 Yui et al. ..... 399/128
5,455,660 A * 10/1995 Kunzmann et al. ..... 399/91
5,504,560 A * 4/1996 Kitagaki et al. ..... 399/168

FOREIGN PATENT DOCUMENTS

JP 06-019264 A 1/1994
JP 6-075457 A 3/1994

(Continued)

OTHER PUBLICATIONS

Office Action (Notification of Reason for Refusal) issued on Jul. 15, 2014, by the Japanese Patent Office in corresponding Japanese Patent Application No. 2012-106008, and an English translation of the Office Action. (9 pages).

*Primary Examiner* — David Gray
*Assistant Examiner* — Andrew V Do
(74) *Attorney, Agent, or Firm* — Buchanan Ingersoll & Rooney PC

(57) ABSTRACT

An image forming apparatus having; an electrostatic latent image support; a charger for charging the electrostatic latent image support; an exposure unit for exposing the electrostatic latent image support with a light beam to form an electrostatic latent image; a development unit for developing the electrostatic latent image into a toner image; a sheet feeding unit for feeding a recording sheet in an image forming operation; a transfer member for transferring the toner image to the recording sheet; a fuser for fusing the toner image onto the recording sheet; and a high-voltage power supply circuit for, in an image forming operation, applying a plurality of bias voltages at least to the charger and to the development unit, wherein the high-voltage power supply circuit supplies a high voltage only to the charger in an operation in an ion generation mode so as to cause the charger to generate ions.

7 Claims, 10 Drawing Sheets

(56) References Cited

FOREIGN PATENT DOCUMENTS

| | | | |
|---|---|---|---|
| JP | 07-104617 | A | 4/1995 |
| JP | 2005-004144 | A | 1/2005 |
| JP | 2005-099505 | A | 4/2005 |
| JP | 2006-267838 | A | 10/2006 |

* cited by examiner

IMAGE FORMING APPARATUS WITH ION GENERATION MODE

This application is based on Japanese Patent Application No. 2012-106008 filed on May 7, 2012, the content of which is incorporated herein by reference.

BACKGROUND OF THE INVENTION

1. Field of the Invention

The present invention relates to an image forming apparatus that is capable of generating negative ions.

2. Description of Related Art

An example of conventional image forming apparatuses that generate negative ions is one disclosed by Japanese Patent Laid-Open Publication No. 2005-4144 (see FIGS. 4 and 5). In the image forming apparatus, an image forming section is provided in a housing, and the image forming section comprises a photoreceptor drum serving as an image support, a charger, etc. The surface of the image support is charged by the charger and is exposed to light modulated in accordance with image data. Thereby, an electrostatic latent image is formed on the surface of the image support.

In two side walls of the housing, a plurality of vent windows, each of which is for air intake or for air exhaust, are made. A blower generates a given airflow through the plurality of vent windows. A negative-ion generator is opposed to one of the vent windows for air exhaust and generates negative ions. Plasma dust collectors are located so as to be opposed to one of the vent windows for air intake and to the negative-ion generator, and the plasma dust collectors each comprise an ion generation part and a filter charged with a polarity opposite to the polarity of ions to be generated by the ion generation part.

However, such a conventional image forming apparatus has a disadvantage of comprising a negative-ion generator exclusively used for generating negative ions, thereby increasing the size and the cost of the apparatus.

SUMMARY OF THE INVENTION

An image forming apparatus according to an embodiment of the present invention comprises: an electrostatic latent image support; a charger for charging the electrostatic latent image support;

an exposure unit for generating a light beam in accordance with input image data and for exposing the electrostatic latent image support with the light beam to form an electrostatic latent image on the electrostatic latent image support; a development unit for developing the electrostatic latent image formed on the electrostatic latent image support into a toner image; a sheet feeding unit for storing a stack of recording sheets and for, in an image forming operation, taking and feeding a recording sheet out of the stack of recording sheets; a transfer member for transferring the toner image formed by the development unit to the recording sheet fed from the sheet feeding unit; a fuser for fusing the toner image onto the recording sheet fed from the transfer member; and a high-voltage power supply circuit for, in an image forming operation, generating a plurality of bias voltages and applying the plurality of bias voltages at least to the charger and to the development unit, wherein the high-voltage power supply circuit supplies a high voltage only to the charger in an operation in an ion generation mode, which is carried out at a time other than a time of performing an image forming operation, so as to cause the charger to generate ions.

BRIEF DESCRIPTION OF THE DRAWINGS

This and other objects and features of the present invention will be apparent from the following description with reference to the accompanying drawings, in which.

DETAILED DESCRIPTION OF THE PREFERRED EMBODIMENTS

Figure 1:
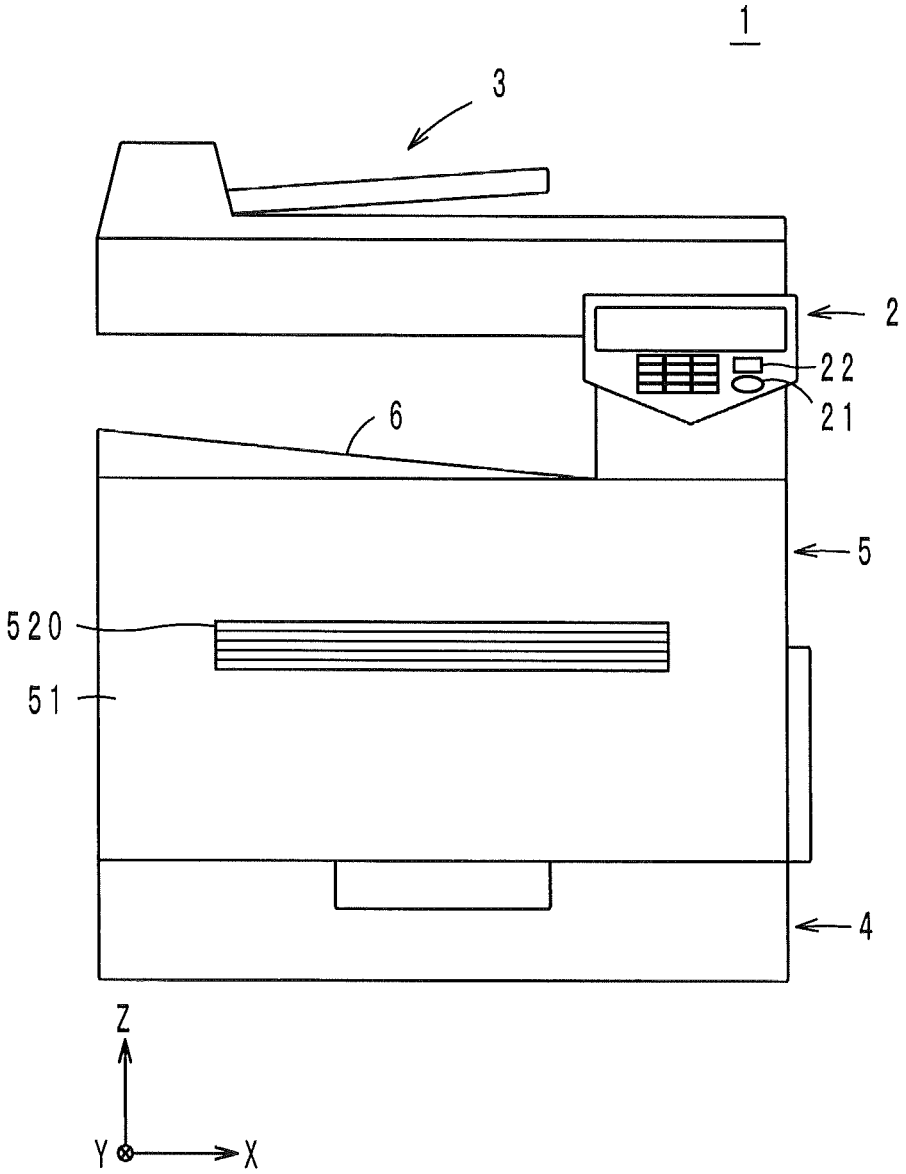
FIG. 1 is a schematic front view of an image forming apparatus according to each embodiment of the present invention.

An image forming apparatus 1 according to each embodiment of the present invention will be hereinafter described with reference to FIGS. 1 to 10. In the drawings, the X-axis, the Y-axis and the Z-axis show the horizontal (right-left) direction, the longitudinal (front-back) direction and the vertical (up-down) direction of the image forming apparatus 1, respectively. In the drawings, the alphabetical capital letters Y, M, C and K attached to the reference signs show yellow, magenta, cyan and black, respectively. For example, a photoreceptor drum 54Y means that it is a photoreceptor drum 54 used for yellow image formation.

Basic Structure of the Image Forming Apparatus

As shown by FIGS. 1 to 6, the image forming apparatus 1 is an electrophotographic tandem-type color printer, and comprises an operation panel 2, a scanner 3, at least one sheet feeding unit 4, a printing unit 5 and a printed-sheet tray 66.

The operation panel 2, which is an exemplary operation device, comprises a plurality of buttons to be operated by a user. The buttons, as shown by FIG. 1, include a print start button 21 for commanding a start of printing and a mode button 22 for commanding an operation in an ion generation mode. Further, by use of an up-down key and a ten-key provided on the operation panel 2, it is possible to input the time duration of negative-ion generation. The mode button 22 is not necessary in a first embodiment which will be described below. The time duration of negative-ion generation will be described later in connection with a fourth embodiment.

The scanner 3, which is an exemplary image input device, for example, automatically scans an image of a document set on an ADF (automatic document feeder) by a user. The scanner 3 reads the image and generates image data composed of data of three primary colors of light, namely, R (red) data, G (green) data and B (blue) data. The TGB image data is converted into YMCK image data by a controller 7, which will be described later.

Figure 2:
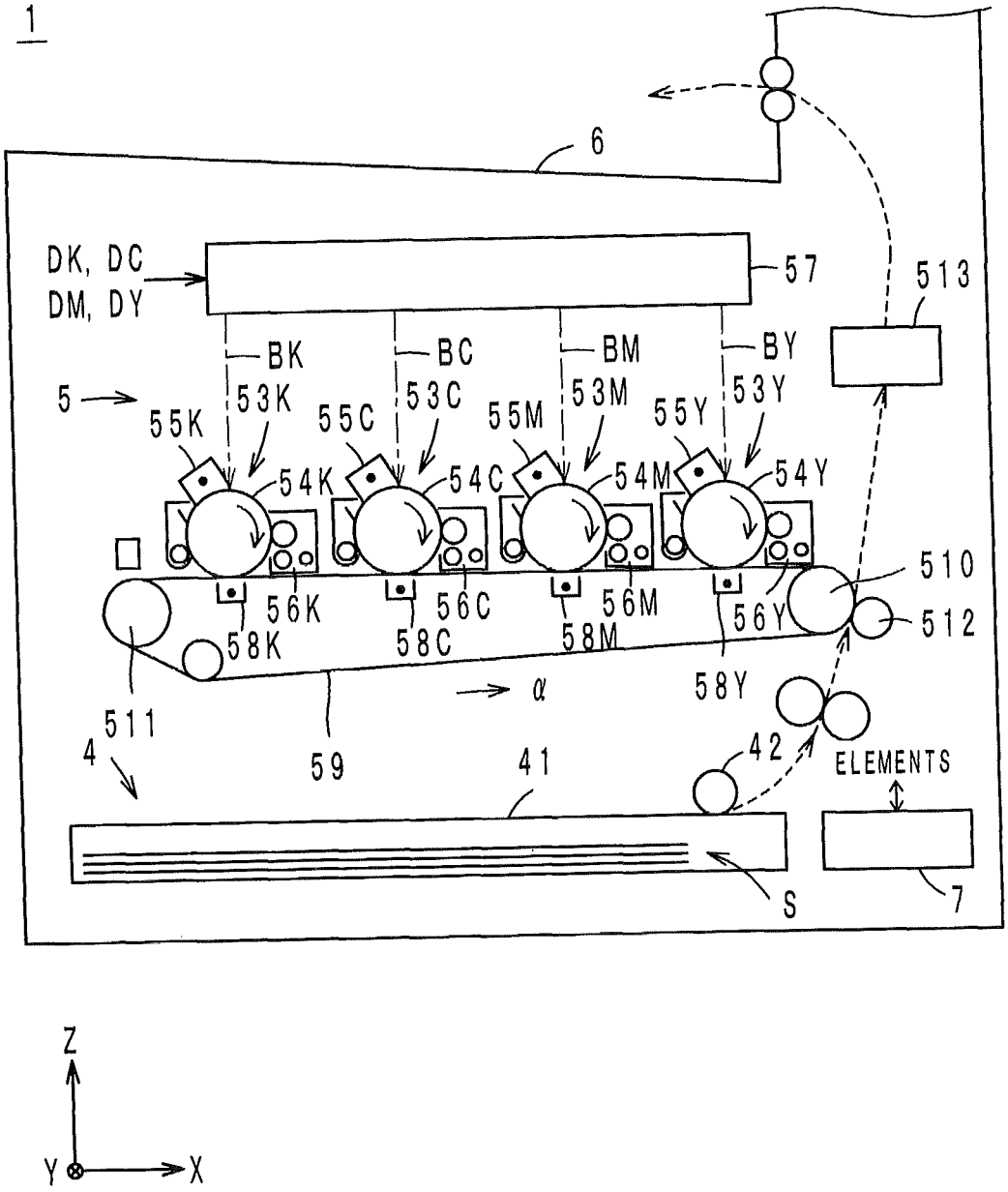
FIG. 2 is a schematic view showing the internal constitution of the image forming apparatus shown by FIG. 1.

The sheet feeding unit 4, as shown by FIG. 2, comprises a feed tray 41 and a feed roller 42. On the feed tray 41, a plurality of unprinted recording sheets S are stacked. The feed roller 42 takes one recording sheet S out of the feed tray 41 and feeds the sheet S toward a transfer nip portion (which will be described later) via a pair of registration rollers.

Figure 4:
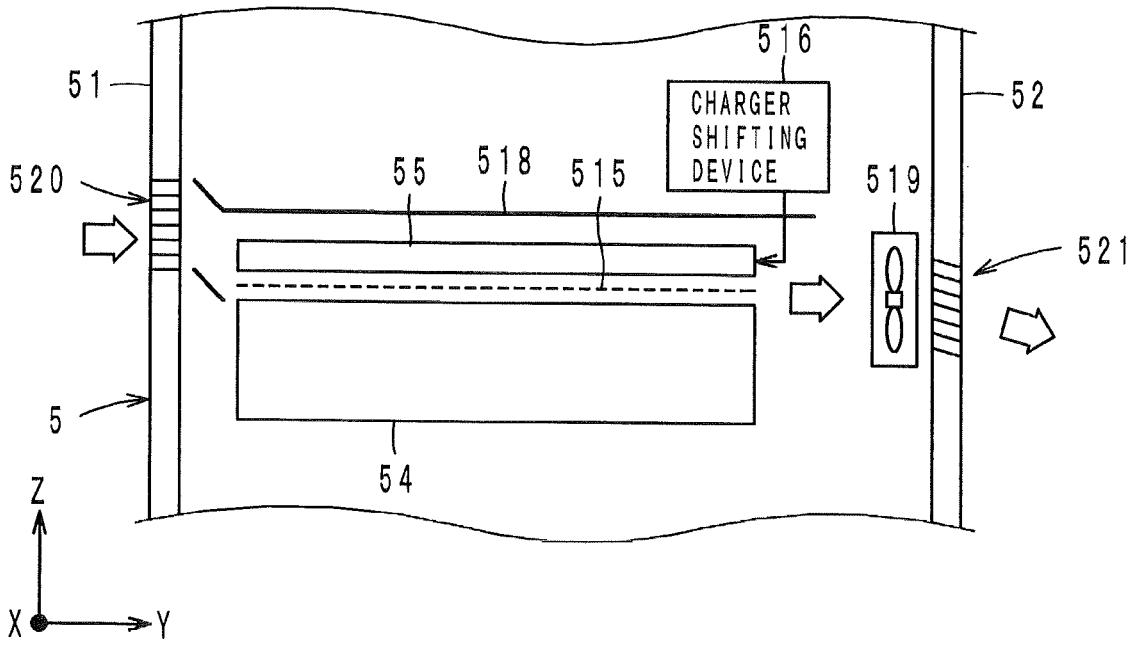
FIG. 4 is a schematic view showing an airflow in the image forming apparatus during the image forming operation.
Figure 6:
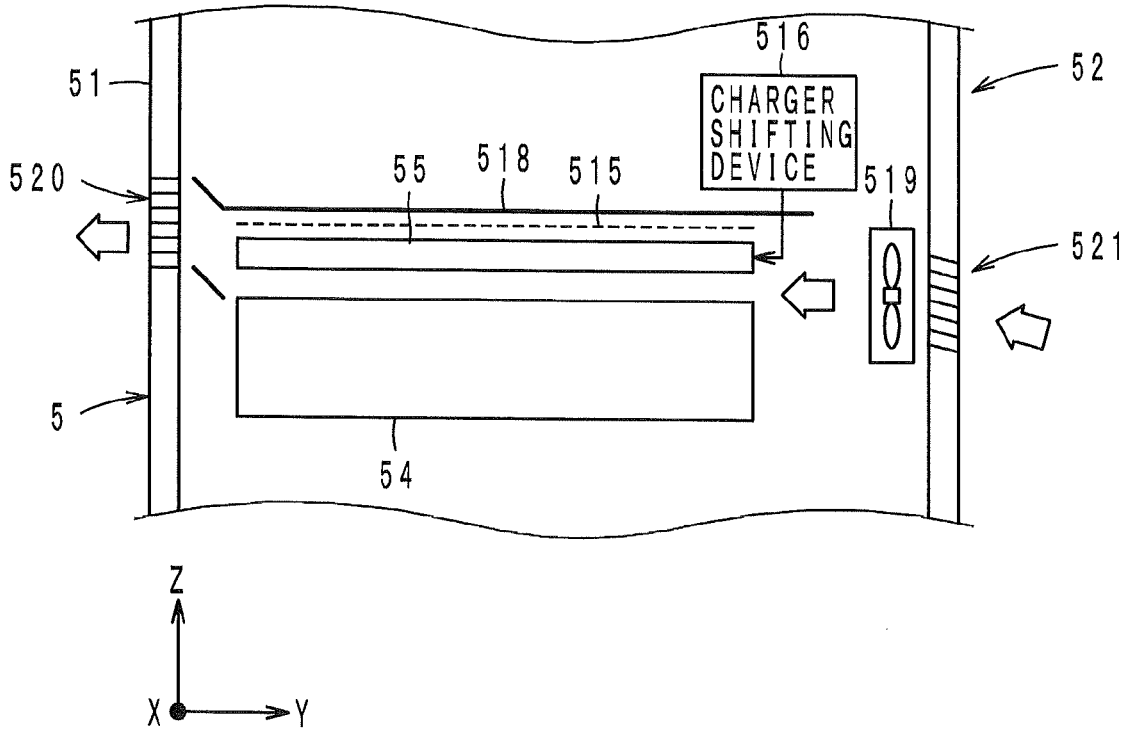
FIG. 6 is a schematic view showing an airflow in the image forming apparatus during the ion generating operation.

The printing unit 5 is located in a housing including a front outer panel 51 and a back outer panel 52 (see FIGS. 4 and 6). The printing unit 5, as shown by FIG. 2, comprises image forming units 53 for forming images in the respective colors of Y, M, C and K, and each of the image forming units 53 comprises a photoreceptor drum 54, a charger 55, a development unit 56, etc. The printing unit 5 further comprises an exposure unit 57, primary-transfer rollers 58 for transfer of images of the respective colors, a transfer belt 59, a driving roller 510, a driven roller 511, a secondary-transfer roller 512, a fuser 513, etc.

The chargers 55 charge the peripheral surfaces of the corresponding photoreceptor drums 54, which are exemplary electrostatic latent image supports. The exposure unit 57 receives image data for the colors Y, M, C and K from the controller 7, and generates light beams modulated in accordance with the image data for the respective colors in a built-in light source (not shown). The photoreceptor drums 54, while rotating in a sub-scanning direction, are scanned in a main-scanning direction with the corresponding light beams for the respective colors. In this way, electrostatic latent images of the respective colors are formed on the peripheral surfaces of the photoreceptor drums 54. The development units 56 supply toner to the peripheral surfaces of the corresponding photoreceptor drums 54 to form toner images of the respective colors.

The primary-transfer rollers 58 transfer the toner images of the respective colors from the peripheral surfaces of the photoreceptor drums 54 to the transfer belt 59 laid between the driving roller 510 and the driven roller 511. On the transfer belt 59, which is an exemplary toner image support, the toner images of the respective colors are combined to turn into a composite toner image.

The driving roller 510 is rotated by a motor (not shown) to drive the transfer belt 59 in a direction shown by arrow $\alpha$ in FIG. 2. The secondary-transfer roller 512, which is an exemplary transfer member, is in contact with the transfer belt 59 to form a transfer nip portion. The recording sheet S fed from the feed roller 42 is introduced into the transfer nip portion. Also, the composite toner image is conveyed to the transfer nip portion with the movement of the transfer belt 59. A transfer bias voltage is applied to the secondary-transfer roller 512, whereby the composite toner image is attracted toward the secondary transfer roller 512, so that the composite toner image is transferred to the recording sheet S introduced into the transfer nip portion S (secondary transfer). After the secondary transfer, the recording sheet S is fed from the transfer nip portion to the fuser 513.

The fuser 513 applies heat and pressure to the recording sheet S fed from the transfer nip portion to fix the composite toner image onto the recording sheet S. The recording sheet S which has been subjected to the fusing process becomes a printed sheet and is ejected to the printed-sheet tray 6 via the pair of ejection rollers. The sequence of actions, to the ejection of a printed sheet to the ejection tray 6, described above will be referred to as an image forming operation in each embodiment which will be described below.

First Embodiment

Figure 3:
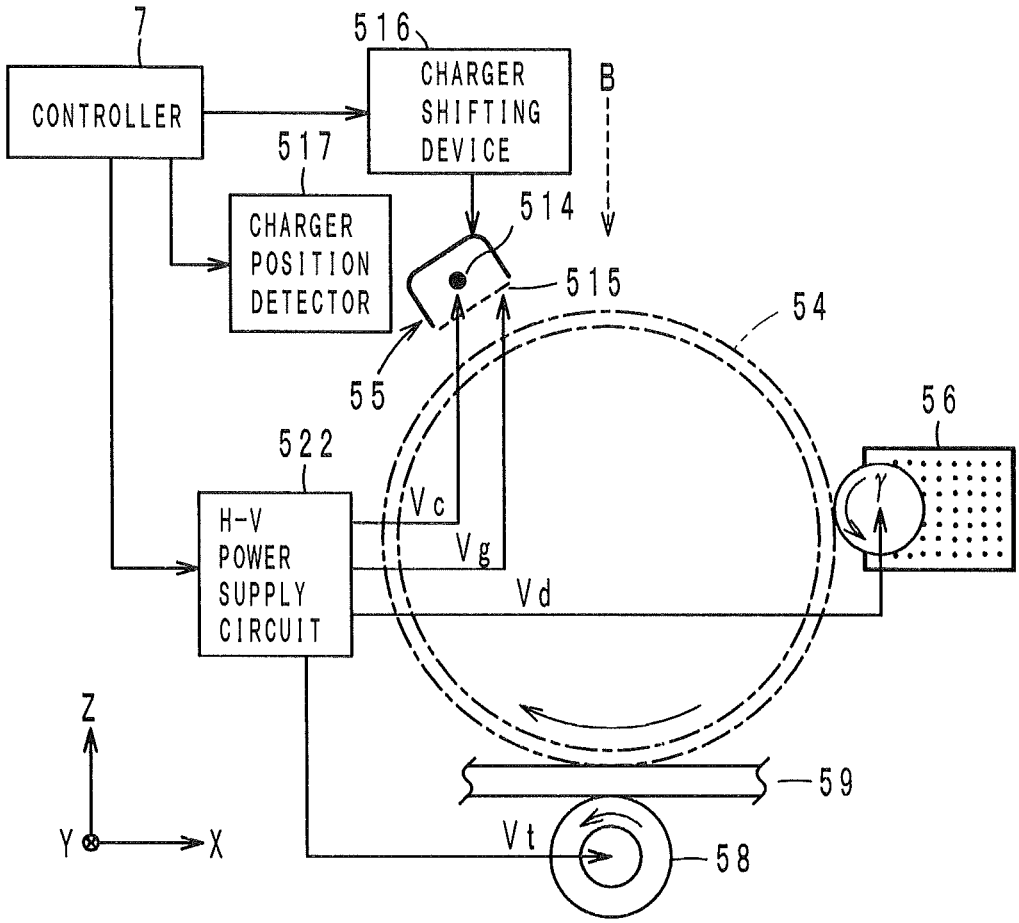
FIG. 3 is a schematic view showing actions of essential elements of the image forming apparatus in an image forming operation.
Figure 5:
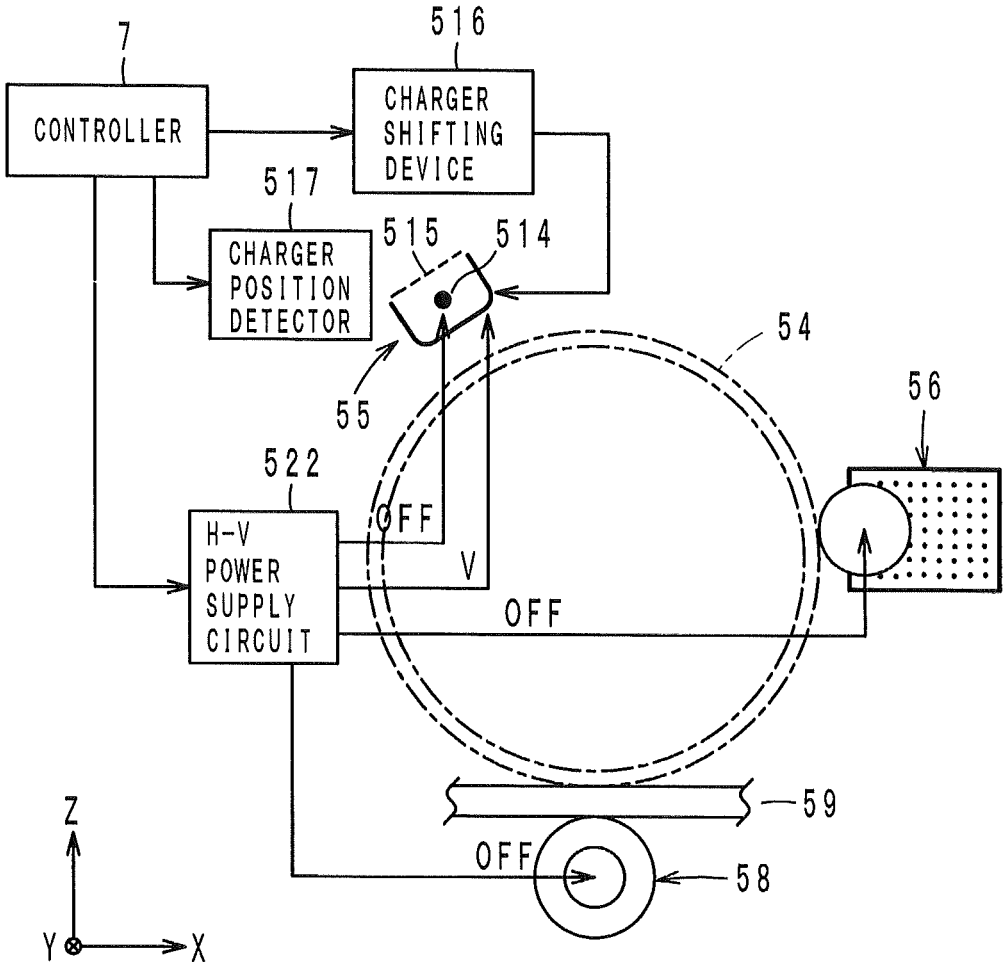
FIG. 5 is a schematic view showing actions of the essential elements of the image forming apparatus in an ion generating operation.

Next, a characteristic constitution of the image forming apparatus according to a first embodiment is described. As shown by FIGS. 3 and 5, each of the chargers 55, which is, for example, a scorotron charger, is located along the corresponding photoreceptor drum 54 and is configured to pivot on a central axis in parallel to the Y-axis. Each of the chargers 55 comprises a discharge electrode 514 and a grid electrode 515. A high-voltage power supply circuit 522 applies a charging bias voltage Vc and a grid voltage Vg to the discharge electrode 514 and the grid electrode 515, respectively.

Around each of the chargers 55, a charger shifting device 516, a charger position detector 517, an air duct 518, a fan 519, a front vent 520 and a back vent 521 are provided.

The charger shifting device 516 is an exemplary photoreceptor protecting device. The charger shifting device 516 includes a motor that is controlled by the controller 7 to cause the charger 55 to pivot for protection of the photoreceptor 54. More specifically, at the time of starting an image forming operation, the charger shifting device 516 causes the charger 55 to pivot such that the grid electrode 515 is positioned between the discharge electrode 514 and the photoreceptor drum 54 (see FIG. 3). This position of the grid electrode 515 will be hereinafter referred to as a facing position. At the time of starting an operation in the ion generation mode, the charger shifting device 516 causes the charger 55 to pivot such that the grid electrode 515 retreats from the facing position (see FIG. 5). This position of the grid electrode 515 will be hereinafter referred to as a retreating position.

The charger position detector 517 is, for example, a photosensor. The charger position detector 517 detects whether the grid electrode 515 is in the facing position or in the retreating position and sends the detection result to the controller 7.

The air duct 518 is located over the charger 55 so as to almost entirely cover the charger 55 extending in parallel to the Y-axis.

The fan 519 is opposed, with respect to the Y-axis, to the back end of the air duct 518. The back end of the air duct 518 means the end of the air duct 518 near the back side of the image forming apparatus 1. The fan 519 is controlled by the controller 7 to rotate on a central axis in parallel to the Y-axis in a forward direction or in a reverse direction. While rotating in the forward direction, the fan 519 takes in air from the front side of the image forming apparatus 1 and exhausts air to the back side of the image forming apparatus 1. While rotating in the reverse direction, the fan 519 takes in air from the back side of the image forming apparatus 1 and exhausts air to the front side of the image forming apparatus 1.

The front vent 520 is made in the front outer panel 51 in a position to face, with respect to the Y-axis, to the front end of the air duct 518, and the back vent 521 is made in the back outer panel 52 in a position to face to the fan 519.

For an image forming operation, the high-voltage power supply circuit 522 not only applies the charging bias voltage Vc and the grid voltage Vg as described above but also generates other bias voltages such as a developing bias voltage Vd, a primary-transfer bias voltage Vt, etc. as shown in FIG. 3 and applies these voltages to the development unit 56, the primary-transfer roller 58 and other corresponding elements. Further, during an operation in the ion generation mode, the high-voltage power supply circuit 522 generates a high voltage Vi and applies this voltage to the discharge electrode 514 as shown in FIG. 5. The high-voltage power supply circuit 522 may be provided for each of the chargers 55 on a one-to-one basis. However, for the purpose of reducing the size and the cost of the image forming apparatus 1, it is preferred that all the chargers 55 share a single high-voltage power supply circuit 522.

The controller 7 comprises a microcomputer, a memory, etc. and controls the elements of the image forming apparatus 1 as shown in FIG. 2.

Figure 7:
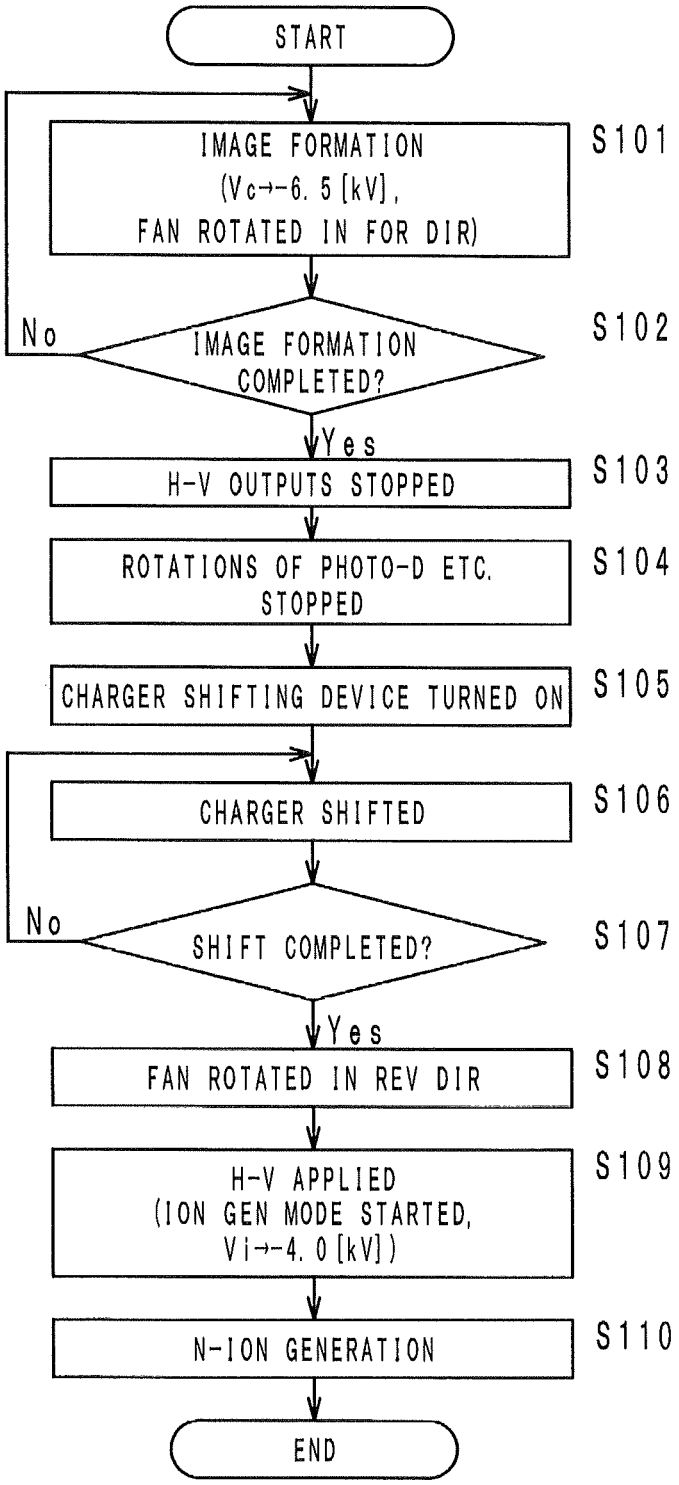
FIG. 7 is a flowchart showing actions of the image forming apparatus according to a first embodiment.

Next, the operation of the image forming apparatus 1 according to this embodiment is described with reference to the flowchart shown by FIG. 7. A user sets a document on a scanner 3 and operates the operation panel 2 to input necessary information. Thereafter, the user presses the print start button 21, whereby an image forming operation is started (S101).

The image forming operation is performed as described above, and only the essential part of this embodiment will be described. At step S101, the grid electrodes 515 of the chargers 55 are in their facing positions as shown by FIGS. 3 and 4, and the high-voltage power supply circuit 522 generates the charging bias voltage Vc (for example, −6.5 [kV]), the grid voltage Vg, the developing bias voltage Vd and the primary-transfer bias voltage Vt, etc., and applies these voltages to the discharge electrodes 514, the grid electrodes 515, the development units 56 and the primary-transfer rollers 58, etc. The voltage value −6.5 [kV] is given merely as an example, and the charging bias voltage Vc typically has different values for different colors.

At step S101, the fan 519 rotates in the forward direction. Thereby, as shown by FIG. 4, air is taken into the image forming apparatus 1 through the front vent 520. The intake air, as shown by the arrows in FIG. 4, flows through the duct 518 toward the back side of the image forming apparatus 1 and is ejected by the fan 519 from the image forming apparatus 1 through the back vent 521.

When the image forming operation is completed ("YES" at step S102), the high-voltage power supply circuit 522 is controlled by the controller 7 to stop applying the high voltages to the discharge electrodes 514, the grid electrodes 515, the development units 56 and the primary-transfer rollers 58, etc. (S103). Further, the controller 7 stops the rotations of various rotating bodies such as the photoreceptor drums 54, developing rollers of the development units 56, the primary-transfer rollers 58, etc. (S104).

After the step S104, the controller 7 sends a control signal to the charger shifting devices 516 to drive the charger shifting devices 516 (S105). Thereby, the chargers 55 start pivoting, whereby the grid electrodes 515 start moving from their facing positions to their retreating positions (S106). When the charger position detectors 517 detect that the corresponding grid electrodes 515 have reached their respective retreating positions, the charger position detectors 517 send detection results to the controller 7. Based on the detection results, the controller 7 recognizes that the chargers 55 have completed pivoting to their retreating positions ("YES" at step S107), and then, the controller 7 starts rotating the fan 519 in the reverse direction (S108). The high-voltage power supply circuit 522 is controlled by the controller 7 to generate only the high voltage V for ion generation and to apply this voltage only to the discharge electrodes 514. Here, the high voltage V is, for example, −4.0 [kV]. In this moment, the image forming apparatus 1 starts an operation in the ion generation mode (S109). In the operation in the ion generation mode, negative ions are generated in the chargers 55, and as shown in FIG. 6, the generated negative ions are blown with the air fed from the fan 519 and are emitted to the outside of the image forming apparatus 1 through the front vent 520 as indicated by the arrows shown in FIG. 6 (S110). In the printing unit 5, ozone as well as the negative ions are generated; however, the generated ozone is removed by a known ozone filter.

Second Embodiment

In a second embodiment, the image forming apparatus 1 operates in a different way from the first embodiment. There is no other difference between the first embodiment and the second embodiment. In the following description of the second embodiment, the elements corresponding to the elements of the first embodiment are provided with the same reference signs, and descriptions of these elements are omitted. This will apply to a third embodiment and a fourth embodiment which will be described later.

Figure 8:
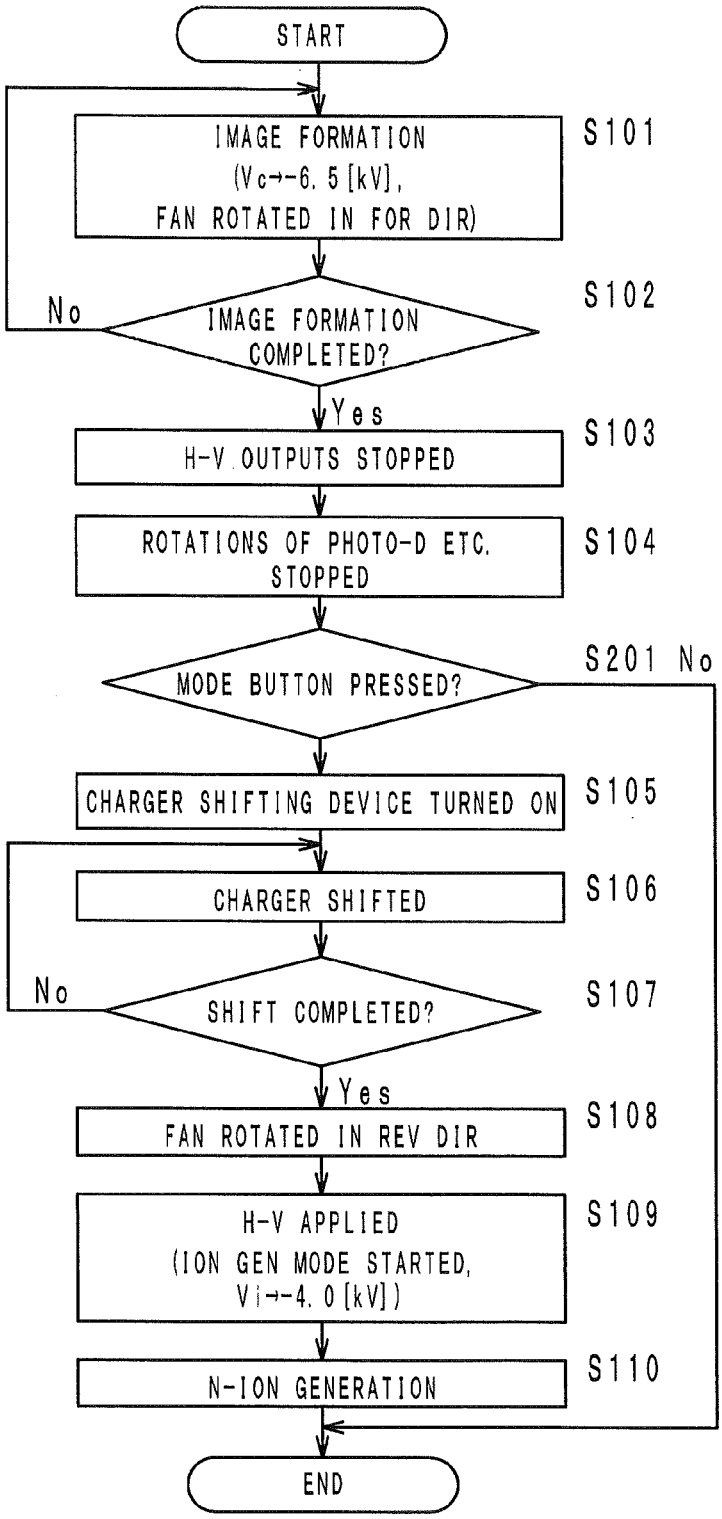
FIG. 8 is a flowchart showing actions of the image forming apparatus according to a second embodiment.

The operation of the image forming apparatus 1 according to the second embodiment is described with reference to the flowchart shown by FIG. 8. Compared with the flowchart shown by FIG. 7, the flowchart shown by FIG. 8 further comprises a step S201. There is no other difference between the flowchart shown by FIG. 7 and the flowchart shown by FIG. 8. Therefore, the steps in FIG. 8 corresponding to the steps in FIG. 7 are provided with the same step numbers, and descriptions of these steps are omitted from the following description.

A user sets a document on a scanner 3 and operates the operation panel 2 to input necessary information. Thereafter, the user presses the print start button 21. Further, the user presses the mode button 21 also if the user desires an operation in the ion generation mode.

In response to the user's pressing the print start button 21, the steps S101 to S104 are carried out as described above. After the step S104, the controller 7 judges whether or not the mode button 22 was pressed (S201). When the controller 7 makes a judgment of "YES" at step S201, the image forming apparatus 1 performs processes at and after step S105. When the controller 7 makes a judgment of "NO" at step S201, the image forming apparatus 1 skips the processes at and after step S105 and stands by for a next image forming operation.

Third Embodiment

Figure 9:
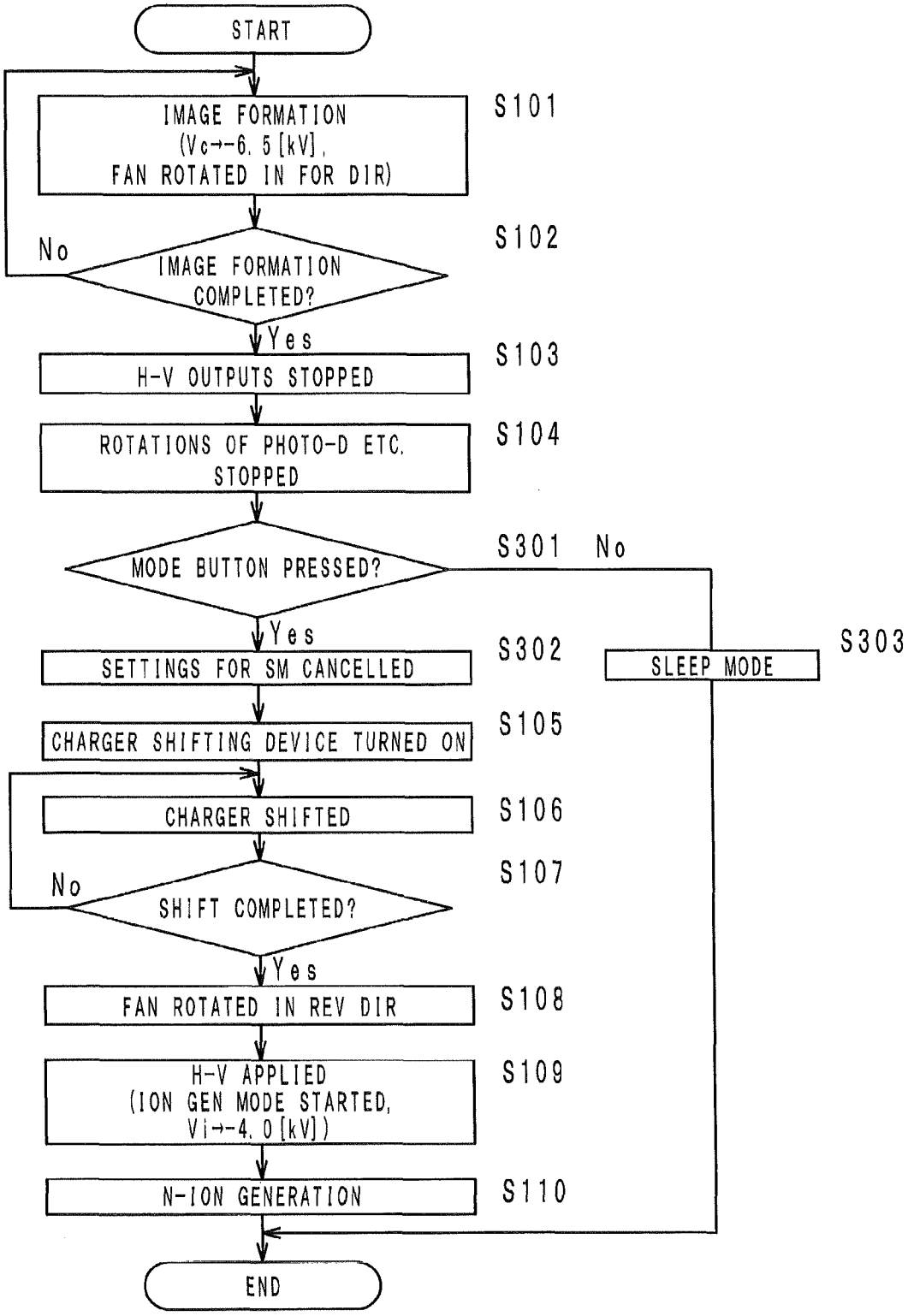
FIG. 9 is a flowchart showing actions of the image forming apparatus according to a third embodiment.

The operation of the image forming apparatus 1 according to a third embodiment is described with reference to the flowchart shown by FIG. 9. Compared with the flowchart shown by FIG. 7, the flowchart shown by FIG. 9 further comprises steps S301 to S303. There is no other difference between the flowchart shown by FIG. 7 and the flowchart shown by FIG. 9. Therefore, the steps in FIG. 9 corresponding to the steps in FIG. 7 are provided with the same step numbers, and descriptions of these steps are omitted from the following description.

A user sets a document on a scanner 3 and operates the operation panel 2 to input necessary information. Thereafter, the user presses the print start button 21. Further, the user presses the mode button 21 also if the user desires an operation in the ion generation mode.

In response to the user's pressing the print start button 21, the steps S101 to S104 are carried out as described above. After the step S104, the controller 7 carries out the same process as the process at S201 (S301). When the controller 7 makes a judgment of "YES" at step S301, the controller 7 cancels the setting for a change to a sleep mode (low power consumption mode) (S302). Thereafter, the image forming apparatus 1 performs processes at and after step S105. When the controller 7 makes a judgment of "NO" at step S301, the image forming apparatus 1 changes into the sleep mode (S303) on a predetermined condition (for example, on the condition that a predetermined time period has passed) and stands by for a next image forming operation.

Fourth Embodiment

Figure 10:
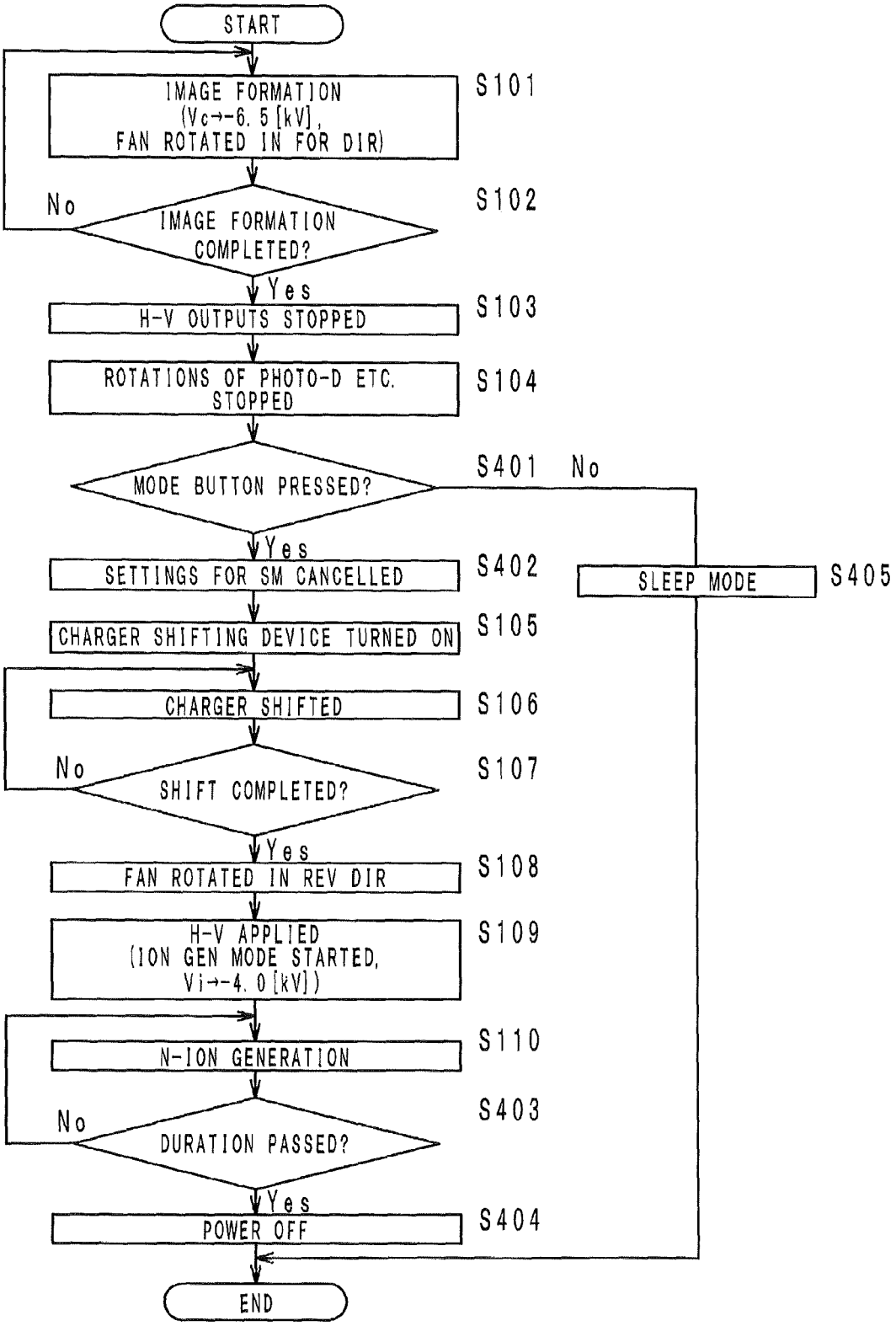
FIG. 10 is a flowchart showing actions of the image forming apparatus according to a fourth embodiment.

The operation of the image forming apparatus 1 according to a fourth embodiment is described with reference to the flowchart shown by FIG. 10. Compared with the flowchart shown by FIG. 7, the flowchart shown by FIG. 10 further comprises steps S401 to S405. There is no other difference between the flowchart shown by FIG. 7 and the flowchart shown by FIG. 10. Therefore, the steps in FIG. 10 corresponding to the steps in FIG. 7 are provided with the same step numbers, and descriptions of these steps are omitted from the following description.

A user sets a document on a scanner 3 and operates the operation panel 2 to input necessary information. Thereafter, the user presses the print start button 21. Further, the user presses the mode button 21 also if the user desires an operation in the ion generation mode. In the fourth embodiment, the duration of negative ion generation is predetermined by default or by an input made by a user on the operation panel 2.

In response to the user's pressing the print start button 21, the steps S101 to S104 are carried out as described above. After the step S104, the controller 7 carries out the same processes as the processes at S301 and S302 (S401 and S402). After the step S402, the image forming apparatus 1 performs processes at and after step S105. The process at step S110 is continued during the duration of negative ion generation, and after the elapse of the duration of negative ion generation ("YES" at step S404), the image forming apparatus 1 is powered off (step S404).

When the controller 7 makes a judgment of "NO" at step S401, the image forming apparatus 1 changes into the sleep mode (S405) on a predetermined condition as mentioned above in connection with step S305 and stands by for a next image forming operation.

Function and Effect of the Image Forming Apparatus

In the embodiments above, the chargers 55 function as chargers for charging the peripheral surfaces of the photoreceptor drums 54 in an image forming operation, and function as negative-ion generators for generating negative ions in an operation in the ion generation mode. Thus, according to the embodiments, generation of negative ions is possible without providing a negative-ion generator for exclusive use, and an image forming apparatus that can generate negative ions can be provided without increasing the size and the cost.

In the embodiments above, wherein each of the chargers 55 comprises a discharge electrode 514 and a grid electrode 515, during an operation in the ion generation mode, the high voltage Vi is applied to the discharge electrodes 514 of the chargers 55 but is not applied to the grid electrodes 515. Therefore, the image forming apparatus 1 uses the high voltage Vi efficiently to generate negative ions.

In the embodiments above, further, high voltages of different values are applied to the discharge electrodes 514 for an image forming operation and for an operation in the ion generation mode. In the embodiments above, the voltage applied for an image forming operation is −6.5 [kV] and the voltage applied for an operation in the ion generation mode is −4.0 [kV]. By changing the applied voltage to appropriate values in such a manner, the power consumption of the image forming apparatus 1 can be kept at a proper level.

In the embodiments above, further, by controlling the direction of rotation of the fan 519, the air duct 518, the fan 519, the front vent 520 and the back vent 521 are used for both an image forming operation and an operation in the ion generation mode. Therefore, it is not necessary to provide an air duct used exclusively for discharge of negative ions, and it becomes possible to provide a small low-cost image forming apparatus.

In the embodiments above, furthermore, the charger shifting devices 516, which are exemplary protectors, move the grid electrodes 516 to their retreating positions where the grid electrodes 516 do not face to the photoreceptor drums 54. Thereby, negative ions are not directed to the photoreceptor drums 54, which are not used for an operation in the ion generation mode, which prevents the photoreceptor drums 54 from suffering electrical stresses, and the photoreceptor drums 54 can be protected. In the embodiments above, the chargers 55 are caused to pivot for protection of the photoreceptor drums 54; however, there are other ways of protecting the photoreceptor drums 54. For example, during an operation in the ion generation mode, shutter members protective against electrical stresses may be inserted between the grid electrodes 515 and the photoreceptor drums 54, instead of causing the chargers 515 to pivot.

In the second to the fourth embodiments, when the mode button 22 is pressed, an operation in the ion generation mode is carried out. Thus, an operation in the ion generation mode is carried out only when a user desires it, and therefore, an increase in the power consumption due to unnecessary performance of the ion generation mode can be prevented.

Especially in the fourth embodiment, in an operation in the ion generation mode, power is supplied only to the elements necessary for generation of negative ions, and negative ions are generated only for a predetermined duration. Therefore, unnecessary power consumption can be avoided.

Other Embodiments

The present invention is applicable to tandem-type image forming apparatuses such as printers, facsimiles, copying machines and multi-functional machines having these functions, and also to printers and other image forming apparatuses adopting a four-cycle method as well as the tandem-type image forming apparatuses.

Although the present invention has been described in connection with the preferred embodiments above, it is to be noted that various changes and modifications are possible for those skilled in the art. Such changes and modification are to be understood as being within the scope of the present invention.

What is claimed is:

1. An image forming apparatus comprising:

an electrostatic latent image support;

a charger for charging the electrostatic latent image support;

an exposure unit for generating a light beam in accordance with input image data and for exposing the electrostatic latent image support with the light beam to form an electrostatic latent image on the electrostatic latent image support;

a development unit for developing the electrostatic latent image formed on the electrostatic latent image support into a toner image;

a sheet feeding unit for storing a stack of recording sheets and for, in an image forming operation, taking and feeding a recording sheet out of the stack of recording sheets;

a transfer member for transferring the toner image formed by the development unit to the recording sheet fed from the sheet feeding unit;

a fuser for fusing the toner image onto the recording sheet fed from the transfer member; and a high-voltage power supply circuit for, in an image forming operation, generating a plurality of bias voltages and applying the plurality of bias voltages at least to the charger and to the development unit;

wherein the high-voltage power supply circuit supplies a high voltage only to the charger in an operation in an ion generation mode, which is carried out at a time other than a time of performing an image forming operation, so as to cause the charger to generate ions;

wherein the charger comprises a discharge electrode and a grid electrode;

wherein the high-voltage power supply circuit, in an image forming operation, generates a plurality of bias voltages and applies the plurality of bias voltages to the discharge electrode of the charger, the development unit and the transfer member, and generates a grid voltage and applies the grid voltage to the grid electrode of the charger; and in an operation in the ion generation mode, supplies a high voltage only to the discharge electrode of the charger.

2. An image forming apparatus according to claim 1, wherein the bias voltage applied to the discharge electrode and the high voltage applied to the discharge electrode are of different values from each other.

3. An image forming apparatus according to claim 2, wherein the bias voltage applied to the discharge electrode is −6.5[kV], and the high voltage applied to the discharge electrode is −4.0[kV].

4. An image forming apparatus according to claim 1, wherein the high-voltage power supply circuit, in an operation in the ion generation mode, supplies the high voltage to the charger to cause the charger to generate ions for a predetermined time period.

5. An image forming apparatus comprising:

an electrostatic latent image support;

a charger for charging the electrostatic latent image support;

an exposure unit for generating a light beam in accordance with input image data and for exposing the electrostatic latent image support with the light beam to form an electrostatic latent image on the electrostatic latent image support;

a development unit for developing the electrostatic latent image formed on the electrostatic latent image support into a toner image;

a sheet feeding unit for storing a stack of recording sheets and for, in an image forming operation, taking and feeding a recording sheet out of the stack of recording sheets;

a transfer member for transferring the toner image formed by the development unit to the recording sheet fed from the sheet feeding unit;

a fuser for fusing the toner image onto the recording sheet fed from the transfer member; and a high-voltage power supply circuit for, in an image forming operation, generating a plurality of bias voltages and applying the plurality of bias voltages at least to the charger and to the development unit;

wherein the high-voltage power supply circuit supplies a high voltage only to the charger in an operation in an ion generation mode, which is carried out at a time other than a time of performing an image forming operation, so as to cause the charger to generate ions;

further comprising:

a front outer panel, which is provided on a front side of the image forming apparatus, comprising a front vent made therein;

a back outer panel, which is provided on a back side of the image forming apparatus, comprising a back vent made therein;

an air duct that is provided over the charger, between the front vent and the back vent; and a blower that is opposed to the front vent or the back vent, wherein the blower rotates in such a manner to exhaust air through the back vent in an image forming operation and rotates in such a manner to exhaust air through the front vent in an operation in the ion generation mode.

6. An image forming apparatus comprising:

an electrostatic latent image support;

a charger for charging the electrostatic latent image support;

an exposure unit for generating a light beam in accordance with input image data and for exposing the electrostatic latent image support with the light beam to form an electrostatic latent image on the electrostatic latent image support;

a development unit for developing the electrostatic latent image formed on the electrostatic latent image support into a toner image;

a sheet feeding unit for storing a stack of recording sheets and for, in an image forming operation, taking and feeding a recording sheet out of the stack of recording sheets;

a transfer member for transferring the toner image formed by the development unit to the recording sheet fed from the sheet feeding unit;

a fuser for fusing the toner image onto the recording sheet fed from the transfer member; and a high-voltage power supply circuit for, in an image forming operation, generating a plurality of bias voltages and applying the plurality of bias voltages at least to the charger and to the development unit;

wherein the high-voltage power supply circuit supplies a high voltage only to the charger in an operation in an ion generation mode, which is carried out at a time other than a time of performing an image forming operation, so as to cause the charger to generate ions;

further comprising a protector for protecting the electrostatic latent image support from ions generated by the charger in an operation in the ion generation mode.

7. An image forming apparatus according to claim 6, wherein the protector is configured to cause the charger to rotate to a position facing away from the photosensitive drum in the ion generation mode.

* * * * *